US005832848A

United States Patent [19]

Reynoldson et al.

[11] Patent Number: 5,832,848

[45] Date of Patent: Nov. 10, 1998

[54] FLUIDIZED BED HEAT TREATMENT FURNACE

[75] Inventors: Ray William Reynoldson, Ringwood North; Andrew Simpson Fitchett, Wantirna, both of Australia

[73] Assignee: Quality Heat Treatment Pty, Ltd., Victoria, Australia

[21] Appl. No.: 538,703

[22] Filed: Oct. 3, 1995

[30] Foreign Application Priority Data

Oct. 3, 1994 [AU] Australia ..... PM 8528

[51] Int. Cl.[6] ..... F23L 1/00

[52] U.S. Cl. ..... 110/348; 110/245; 110/190; 432/58; 165/104.16; 34/363; 34/370

[58] Field of Search ..... 110/245, 189, 110/348, 190; 165/104.16; 432/48, 58; 34/359, 363, 370; 266/249

[56] References Cited

U.S. PATENT DOCUMENTS

| | | | |
|---|---|---|---|
| 4,013,279 | 3/1977 | Virr | 266/249 |
| 4,340,433 | 7/1982 | Harding | 148/16 |
| 4,392,814 | 7/1983 | Harding | 110/245 X |
| 4,752,061 | 6/1988 | Dalton et al. | 266/87 |
| 5,189,813 | 3/1993 | Heath et al. | 110/245 X |

*Primary Examiner*—Henry A. Bennett
*Assistant Examiner*—Susanne C. Tinker
*Attorney, Agent, or Firm*—Pollock, Vande Sande & Priddy

[57] ABSTRACT

A fluidized bed heat treatment apparatus is provided to be heated by combusting fuel gas in a manner to minimize or prevent the exhaust of carbon monoxide, the apparatus including a retort containing refractory particles to be fluidized, a first inlet in a lower region of the retort for introducing fuel/air mixture into the retort, a second inlet in a lower region of the retort for introducing secondary air into the retort, a temperature sensor located above the first and second inlets, a flame initiator located above the refractory particles, an externally located mixer to mix fuel and air in desired proportions and to supply same to the first inlet, and a control device arranged to control said externally located mixer in response to temperatures sensed by said temperature sensor whereby when the temperature sensor is below a predetermined temperature indicative of the bed being substantially not fluidized, a stoichiometric fuel/air mixture is supplied to the first inlet and when the temperature sensor senses a temperature above the predetermined level indicative of the bed being substantially fluidized, a less than stoichiometric fuel/air mixture is supplied to the first inlet with secondary air being supplied through said second inlet.

12 Claims, 3 Drawing Sheets

FLUIDIZED BED HEAT TREATMENT FURNACE

BACKGROUND OF THE INVENTION

The present invention relates to fluidized bed heat treatment furnaces, particularly of the kind used for high temperature heat treatment of metallic objects.

Such fluidized heat treatment furnaces are well known and typically comprise a treatment retort containing refractory particles that are heated directly or indirectly and fluidized by a suitable gas flow. The metallic objects are then placed into the fluidized heated refractory particles for a desired heat treatment period. The heating means for such furnaces may be electrically based or alternatively may be based on combusting a fuel such as a fuel gas or the like. Electrically heated furnaces operate quite satisfactorily, however, in some areas electricity supplies may be unavailable or if available, may be prohibitively expensive. Gas or other fuel fired furnaces currently available may comprise a heating mantle in an outer retort surrounding the inner retort but such arrangements provide difficulties in controlling uniform heating in the inner treatment retort and tend to be quite inefficient in relation to energy use.

In another known arrangement fuel gas may be directly combusted in the inner treatment retort zone but this has difficulties in controlling the atmosphere around the objects being treated.

A still further known arrangement is to provide a second fluidized bed zone around the inner treatment zone and combusting the fuel gas in this outer region. Examples of these various arrangements may be found in U.K. Patent Nos. 1,537,486, 1,567,909, 1,558,969 and 2,051,601. Such arrangements increase the efficiency of energy usage relative to arrangements having a simple gas mantle around the inner treatment retort.

One difficulty with gas fired and heated fluidized heat treatment furnaces is that it is becoming increasingly a necessary requirement that exhaust gases contain minimal or no pollutant gases such as carbon monoxide (CO) over their entire period of possible emission including start up of the furnace. A number of different factors apply in relation to satisfactory operation of a heat treatment fluidized bed. Firstly, the gas flow rate necessary to fluidize the bed depends on several factors including particle size, overall particle volume and temperature of the bed. The gas flow rate for optimum heat transfer efficiency is significantly greater than the minimum required to effect fluidization of the bed. The optimum flow rate may be of the order of two and a half times the minimum flow rate to create fluidization of the bed. The gas flow rate required also drops as temperature of the bed rises. Ideally, variation of gas flow might be desirable as the temperature of the bed rises, although, this is not possible in practice because as the temperature of the bed rises the input of heat required increases which in turn increases the volume of gas and air required instead of decreasing in accordance with the principles of aggregative fluidized beds. Thus, a constant gas flow rate may be selected at start up equivalent to that which would be required during usual operating temperatures (i.e. of the order of 600° to 1150° C.), however, this is not sufficient to fluidize the bed when the bed is not up to its normal operating temperature. Thus the bed acts as a fixed bed.

Other related issues that need to be considered include that the fuel gas/air inlet manifold needs to be protected from excessive heat that could cause melt down, possibly as a result of combustion occurring in the manifold itself. Thus, it is necessary to ensure that combustion occurs in the bed and not directly adjacent to or within the fuel gas/air inlet manifold. To achieve this, it is usual to provide arrangements whereby a fuel gas rich/air mixture is supplied to the inlet manifold with secondary air being supplied at one or more locations upwardly in the bed. These arrangements work satisfactorily when the bed is fluidized since fluidization also mixes the secondary air with the fuel gas rich/air stream thus providing good combustion. However, when the fixed bed is being heated at start up, the bed is not fluidized and satisfactory mixing with the secondary air stream does not occur thereby causing poor combustion and significant carbon monoxide carry over into the exhaust gases.

The objective therefore of the present invention is to provide a method of operation of a fluidized bed for heat treatment purposes and fluidized bed heat treatment apparatus which will overcome or minimize the above discussed difficulty.

SUMMARY OF THE INVENTION

According to the present invention there is provided a fluidized bed heat treatment apparatus comprising at least one retort containing refractory particles to be fluidized, first inlet means for introducing a fuel/air mixture to a lower region of said retort, second inlet means for introducing secondary air into said retort temperature sensing means arranged to sense temperature in said retort at a level above said first inlet means, fuel/air mixing means connected to said first inlet means whereby in a first mode of operation a fuel/air mixture of at least stoichiometric proportions is supplied to said first inlet means when temperature sensed by said temperature sensing means is below a predetermined temperature, and in a second mode of operation when the temperature sensed by said temperature sensing means is above said predetermined level, said fuel/air mixture is adjusted to be less than stoichiometric proportions with secondary air being supplied via said second inlet means.

According to the present invention, there is provided a method of operating a fluidized bed heat treatment apparatus having at least one retort containing refractory particles to be fluidized, said retort having first inlet means for introducing a fuel/air mixture to a lower region of said retort, second inlet means for introducing secondary air into said retort, temperature sensing means arranged to sense temperature in said retort at a level above said first inlet means, and fuel/air mixing means connected to said first inlet means, said method comprising steps of when the temperature sensed by said temperature sensing means is below a predetermined level, supplying at least a stoichiometric fuel/air mixture from said mixing means to said first inlet means, and when the temperature sensed by said temperature sensing means exceeds said predetermined level, a less than stoichiometric fuel/air mixture is supplied from said mixing means to said first inlet means with secondary air being supplied to said retort through said second inlet means.

By this method and apparatus, it is possible to supply a stoichiometric fuel/air mixture to the retort at start up at a volume rate less than that necessary to fluidize the bed when cold (or below normal operating temperatures) so that combustion initially occurs on top of the refractory particle bed being commenced by a combustion initiator such as a pilot light or the like. Because the mixture is at least at stoichiometric proportions, complete combustion occurs and minimal or no carbon monoxide carries over into the exhaust gases. The bed heats up from the top down and progressively reaches temperature levels sufficient to fluidize the bed at the relatively constant gas volume flow rates used. The predetermined temperature is conveniently a temperature which will indicate the bed will be fluidized at or above the temperature sensor with the gas flow rates used. The positioning of the temperature sensing device is such as to indicate a substantial portion of the bed is fluidized when it senses the predetermined temperature. Thus, at this point in time, a less than stoichiometric mixture is then introduced into the first inlet means with secondary air being introduced through the second inlet means so that the now fluidized bed adequately mixes the less than stoichiometric fuel/air stream with the secondary air so that at least a stoichiometric mixture combusts within the retort but above the first inlet means.

Conveniently, the aforesaid at least one retort is a fluidized bed located around or at least partially around second retort means acting as a treatment zone for products to be heat treated. Conveniently, the second retort means comprises at least a second fluidized bed. The outer fluidized bed acts as an external heat source for heating up the inner or second fluidized bed. In a second embodiment, the second retort means may be formed by one or more zones (substantially free of refractory particles) within the at least one retort, the or each zone being adapted to receive products to be heat treated.

The second inlet means may conveniently be arranged just above the first inlet means although it is possible for same to be located further up the outer retort or even above the level of the particulate material in the outer retort.

In accordance with a second aspect of the present invention, it is desired to provide an arrangement in one heat treatment (fluidized bed) furnace, the possibility of heat treatment of differing products at the same time. According to this second aspect, there is provided a furnace comprising an outer retort, and one or more inner retorts positioned substantially horizontally, the or each of said inner retorts being provided with conveyor means therethrough so as to enable continuous treatment of treatable products. Conveniently, heating of the aforesaid inner retort or retorts is achieved by providing a particulate material surrounding or partially surrounding the inner retort or retorts, means for fluidizing said particulate material, and means for heating said particulate material. Preferably the means for heating and fluidizing said particulate material includes combusting in said outer retort, a combustible gas introduced into said outer retort.

This aspect of the invention is predicated on the discovery that the efficiency of heating and maintenance of temperature conditions within the inner retort or retorts is substantially improved by the aforesaid arrangements. Furthermore, by providing multiple treatment retorts within the one furnace it is possible to treat differing batches of products, but in a time efficient manner. It is also possible to maintain the integrity of separating batches without sacrificing treatment efficiencies. This arrangement is particularly suited to the treatment of small products.

Any type of conveyor means may be suitable. Particularly preferred, however, are screw feed conveyors, return pusher feed mechanisms or reciprocating hearth (shaker) mechanisms. The type of conveyor used will depend on the conditions used and the type of product being treated.

BRIEF DESCRIPTION OF THE DRAWINGS

Further preferred aspects of the invention will be evident from the following description of several practical embodiments given in relation to the accompanying drawings, in which.

DESCRIPTION OF THE PREFERRED EMBODIMENTS

Figure 1:
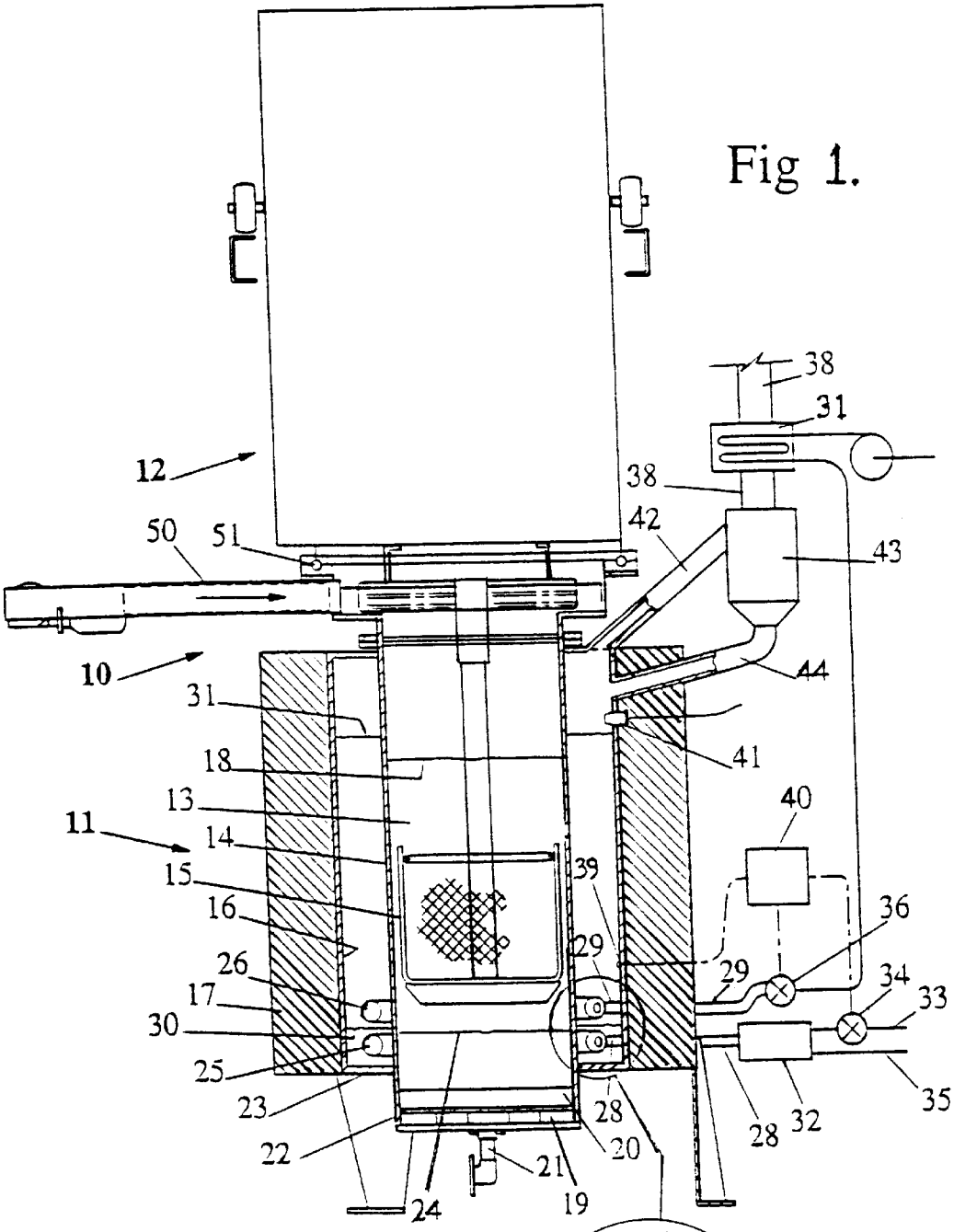
FIG. 1 illustrates an elevational cross-section of a furnace according to a first aspect of the invention.

Referring now to FIG. 1, heat treatment apparatus 10 is illustrated comprising a treatment furnace 11 with a hood structure 12. The hood structure 12 covers a treatment zone 13 formed by a primary retort 14. The hood structure allows any desired atmosphere to be maintained in the treatment zone 13 and allows product to be lowered into or removed from the treatment zone 13 via a basket 15 or the like. The hood structure 12 may include mechanisms for lifting the basket 15 out of the treatment zone 13 or depositing the basket 15 into the treatment zone 13. The hood structure 13 may also be movable between different heat treatment apparatus 10 and carry with it seal means 51 to effectively close the zone within the hood and the heat treatment apparatus 10 from the external atmosphere. Conveniently, a slide cover mechanism 50 is provided to close the top of apparatus 10 when the hood structure is removed therefrom. Alternatively, the hood structure 12 could, if desired, be replaced by a conventional furnace closure arrangement. The furnace 11 comprises the primary retort 13 which is surrounded by a secondary annular retort 16 with an insulating material layer 17 disposed outwardly of the retorts 11 and 16.

The treatment zone 13 is filled with a refractory particulate material up to the level indicated at 18. The base of this retort 11 is formed by a gas flow distribution chamber 19 supporting a porous refractory material plate 20 which allows gas flow to be evenly distributed over the full area of the inner retort 11. An appropriate fluidizing gas supply of any desired type is provided via pipe 21 to the distribution chamber 19. It will of course be appreciated that any other form of gas distribution could also be utilized to achieve appropriate fluidization of the refractory particulate material. It is particularly preferred that the lower regions 22 of the inner retort 11 project downwardly below the base 23 of the outer retort 16 such that the distribution plate 20 is housed within this depending region 22. It is also preferred that the particulate material immediately above the plate 20 up to, for example, level 24, has a coarser grain size than the remainder of the refractory particulate material. In this manner the distribution plate 20 is protected and kept relatively cool.

Figure 1A:
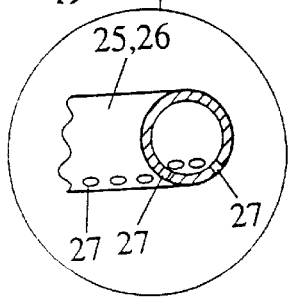
FIG. 1A is an enlarged view of a portion of the furnace shown in FIG. 1.

Arranged within the base region of the outer retort 16, there is provided a first lower inlet distribution tube 25 and a second upper inlet distribution tube 26. As shown in FIG. 1A, each tube has a series of downwardly and outwardly extending discharge apertures 27 arranged to permit gas flow into the annular outer retort 16. The tubes 25, 26 are respectively fed by one or more pipes 28, 29 as will be described in greater detail hereinafter. The lower distribution tube 25 is conveniently located within a zone of relatively coarser grain size refractory particulate material up to the level indicated by 38. The upper distribution tube 26 is conveniently located in the lower zone of a relatively finer grain size refractory particulate material that fills the remainder of the outer retort 16 up to the level indicated by 31.

Outwardly of the furnace 11, a gas mixing arrangement 32 is provided arranged to receive a combustible fuel gas (such as butane, propane, natural gas or manufactured gas) via line 33 and a valve arrangement 34 and in which said fuel gas is mixed with air received via line 35. The pipe 29 is adapted to supply secondary air to the distribution tube 26. This may be delivered via a valve arrangement 36 from a heat exchanger 37 arranged in an exhaust stream 38 from the furnace 11. A temperature sensing device 39 is provided to sense temperature in the retort 16 at a level above the lower distribution ring 25 and preferably above the upper distribution ring 26. The temperature sensed by the device 39 is used in a control device 40 to control valve arrangements 36 and 34 as described hereinafter. Above the level 31, a combustion initiating device (such as a pilot light or the like) 41 is provided. At the upper end of the retort 16, an exhaust passage 42 leads to a cyclone separator 43 which separates particulate material from the exhaust flow for return via passage 44 to the retort 16.

Operation of the above described apparatus is generally as follows. At start up when the system is cool, the valve arrangement 34 is adjusted to ensure at least a stoichiometric mixture of fuel gas and air flows into distribution ring 25. This may constitute all gas flow into the retort and, for example, the secondary air flow through distribution ring 26 may be prevented by closure of the valve arrangement 36. At this stage, the particulate material in the retort 16 is not fluidized and the introduced stoichiometric combustible mixture simply flows to the top of the retort to be combusted upon ignition by the device 41. This situation continues and the particulate material gradually heats up from the top down with the particulate material similarly becoming fluidized from the top down. The temperature of the particulate material rises with the temperature sensing device 39 eventually sensing a predetermined level indicating that a substantial portion of the bed above the sensing device 39 is in a fluidized state. Once this predetermined temperature is sensed, the control device changes the mixing arrangement valve 34 to ensure the fuel gas/air mixture entering the distribution tube 25 is less than stoichiometric proportions and the valve 36 is opened to admit secondary air (preferably heated) by exchange with the exhaust gases from the system. Stoichiometric natural gas to air proportions may, for example be about 1:10 and the flow through the distribution tube 25 may be proportioned of the order of 1:2 after the predetermined temperature is sensed with the remainder of the air introduced through distribution tube 26.

Figure 2:
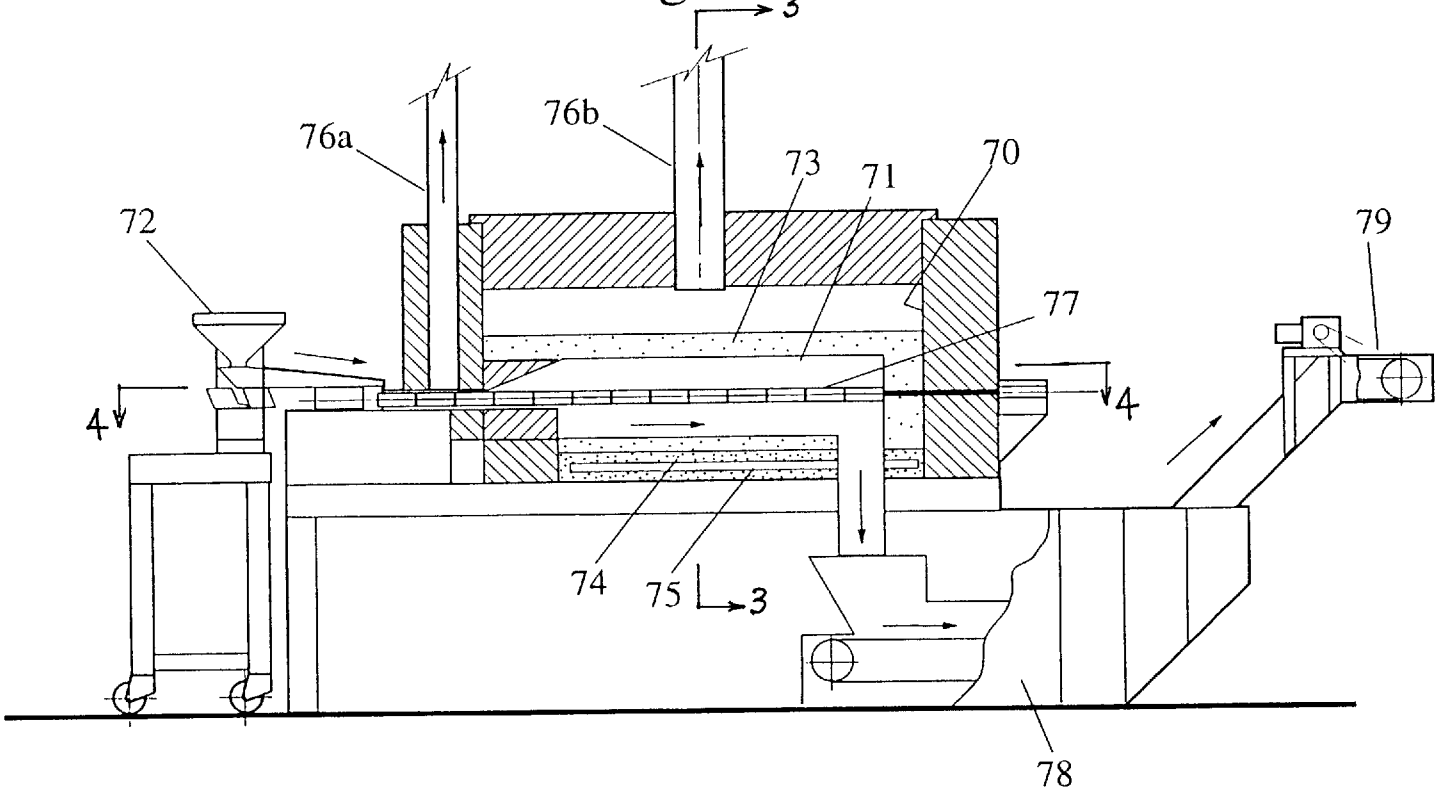
FIG. 2 is an elevational cross-section of a schematic representation of a furnace according to the second aspect of the invention.
Figure 3:
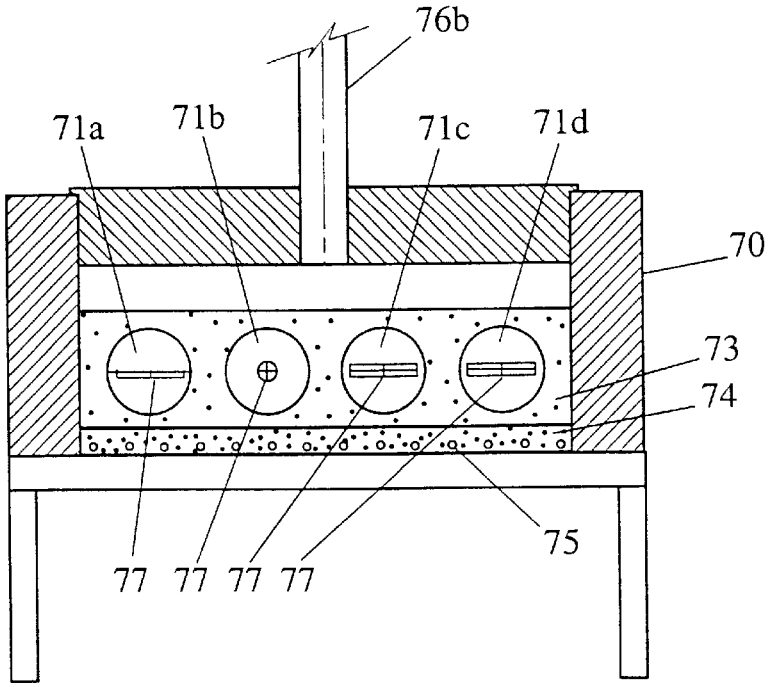
FIG. 3 shows an elevational cross-section along line 3—3 of the representation of the invention shown in FIG. 2.
Figure 4:
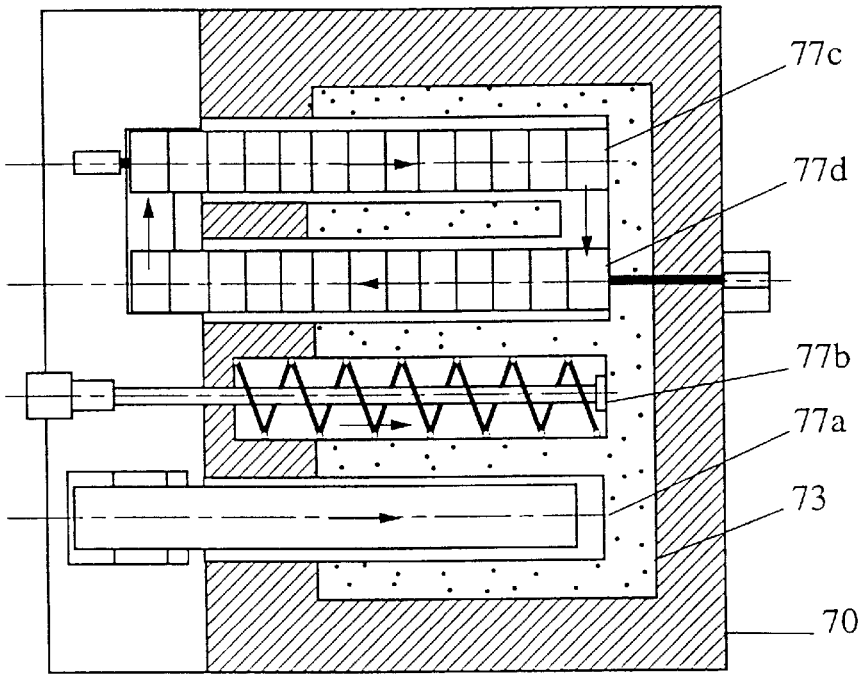
FIG. 4 shows a section view along the line 4—4 of the representation of the invention shown in FIG. 2.

A second aspect of the invention is shown in FIGS. 2 to 4 wherein multiple inner retorts may be contained within the one outer retort, and wherein each substantially horizontal inner retort chamber may be provided with conveyor means.

An outer retort 70 is produced with one or more substantially horizontal inner retorts 71*a, b, c, d*, each of which may be fed batch-wise simultaneously or separately by products to be treated introduced by way of a volumetric feeder 72, or like means. In the cavity between the outer retort 70, and the inner retorts 71*a, b, c, d*, a fluidized bed 73 is provided which is heated by means of a combustible fuel and air mixture introduced via pipes 75 and combusted within the outer retort 70. One or more of the pipes 75 may also be provided to introduce secondary air into the fluidized bed. The arrangement of combustible gas and secondary air inlet means may, if desired be similar to that shown and discussed in the preceding specification with reference to FIG. 1. This gas also fluidizes the particle material 73 within outer retort 70. Conveniently the particle material 74 is coarser than the particle material 73 and acts as a diffuser and is not fluidized in operation. Expanded or waste gases are able to escape the furnace by flue 76*b*. Products treated travel in the direction indicated in FIG. 3, along the conveyor means 77 and drop off the conveyor means 77 into a quench tank 78. The treated products are then retrieved from the quench tank 78 by means of an elevator means 79. Conveniently some form of control atmosphere is maintained within the inner retort, the control atmosphere gases being removed via flue 76*a*.

FIG. 4 particularly shows the type of conveyor means possible: a reciprocating hearth feed mechanism 77*a*, a screw feed mechanism, 77*b*, or a return pusher feed mechanism requiring two parallel but associated retorts 77*c, d*. It will of course be appreciated that any number of inner retorts could be utilized or any combination of the type of conveyor means could be used.

This arrangement is particularly suited to the treatment of small products and each conveyor means previously described is more suitable usually than others for certain products.

We claim:

1. A fluidized bed heat treatment apparatus comprising at least one retort containing refractory particles to be fluidized, first inlet means for introducing a fuel air mixture to a lower region of said retort, second inlet means for introducing secondary air into said retort, temperature sensing means arranged to sense temperature in said retort at a level above said first and second inlet means, fuel/air mixing means connected to said first inlet means whereby in a first mode of operation, a fuel/air mixture of at least stoichiometric proportions is supplied to said first inlet means when temperature sensed by said temperature sensing means is below a predetermined temperature and in a second mode of operation, when the temperature sensed by said temperature sensing means is above said predetermined level, said fuel/air mixture is adjusted to be less than stoichiometric proportions with secondary air being supplied via said second inlet means.

2. A fluidized bed heat treatment apparatus according to claim 1, comprising at least two retorts with said at least one retort at least partially surrounding a second retort.

3. A fluidized bed heat treatment apparatus according to claim 2, wherein said second retort comprises a second fluidized bed.

4. A fluidized bed heat treatment apparatus according to claim 3, wherein said second fluidized bed includes a gas flow distribution region in a base zone of the second fluidized bed for introducing a fluidizing gas flow to said second fluidized bed, said gas flow distribution region in the base zone of said second fluidized bed extending downwardly below a bottom region of said one retort.

5. A fluidized bed heat treatment apparatus according to claim 4, wherein said gas flow distribution region includes a porous refractory material gas distribution plate.

6. A fluidized bed heat treatment apparatus according to claim 2, wherein the second retort comprises one or more zones at least partially within said at least one retort, the or each said zone being adapted to receive products to be heat treated.

7. A fluidized bed heat treatment apparatus according to claim 6, wherein conveyor means is provided to convey products to be heat treated through the or each said zone.

8. A fluidized bed heat treatment apparatus according to claim 1, wherein the second inlet means is located at a level above that of the first inlet means.

9. A fluidized bed heat treatment apparatus according to claim 1, wherein refractory particles of a relatively coarser grade are located in the lower regions of said at least one retort relative to refractory particles in upper regions of said at least one retort.

10. A fluidized bed heat treatment apparatus according to claim 1, wherein flame ignition means is provided in said at least one retort located above the refractory particles contained therein.

11. A method of operating a fluidized bed heat treatment apparatus having a first retort containing refractory particles to be fluidized, said first retort having first inlet means for introducing a fuel/air mixture to a lower region of said first retort, second inlet means for introducing secondary air into said first retort, temperature sensing means arranged to sense temperature in said retort at a level above said first and second inlet means, and fuel/air mixing means connected to said first inlet means, said method comprising the steps of, when the temperature sensed by said temperature sensing means is below a predetermined level, supplying at least a stoichiometric fuel/air mixture from said mixing means to said first inlet means and when said temperature sensed by said temperature sensing exceeds said predetermined level, a less than stoichiometric fuel/air mixture is supplied from said mixing means to said first inlet means with secondary air being supplied to said retort through said second inlet means.

12. A method according to claim 11, wherein the predetermined temperature is such as to indicate the refractory particles in said first retort is fluidized at and above said temperature sensing means.

* * * * *